US007033234B2

(12) United States Patent
Arvidsson et al.

(10) Patent No.: US 7,033,234 B2
(45) Date of Patent: Apr. 25, 2006

(54) METHOD OF STEERING A BOAT WITH DOUBLE OUTBOARD DRIVES AND BOAT HAVING DOUBLE OUTBOARD DRIVES

(75) Inventors: Lennart Arvidsson, Kållered (SE); Oddbjörn Hallenstvedt, Valskog (SE); Jukka Tuuliainen, Köping (SE)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 10/513,310

(22) PCT Filed: Apr. 29, 2003

(86) PCT No.: PCT/SE03/00688

§ 371 (c)(1),
(2), (4) Date: May 18, 2005

(87) PCT Pub. No.: WO03/093102

PCT Pub. Date: Nov. 13, 2003

(65) Prior Publication Data

US 2005/0227553 A1 Oct. 13, 2005

(30) Foreign Application Priority Data

May 3, 2002 (SE) ..... 0201343

(51) Int. Cl.
*B63H 21/22* (2006.01)

(52) U.S. Cl. ..... 440/1; 440/80

(58) Field of Classification Search ..... 440/1, 440/80
See application file for complete search history.

(56) References Cited

U.S. PATENT DOCUMENTS

| | | | | |
|---|---|---|---|---|
| 4,040,379 | A * | 8/1977 | Betts | 440/79 |
| 4,846,741 | A * | 7/1989 | Betsinger | 440/57 |
| 5,575,230 | A * | 11/1996 | Eronen | 114/61.11 |
| 5,755,605 | A | 5/1998 | Asberg | |
| 6,783,410 | B1 * | 8/2004 | Florander et al. | 440/51 |
| 2003/0139102 | A1 * | 7/2003 | Florander et al. | 440/83 |

OTHER PUBLICATIONS

Patent Abstracts of Japan, vol. 010, No. 388 (M549), Dec. 25, 1986 & JP 61 178294 A (Mitsubishi Heavy Ind Ltd), Aug. 9, 1986 abstract.

* cited by examiner

*Primary Examiner*—Stephen Avila
(74) *Attorney, Agent, or Firm*—Young & Thompson

(57) ABSTRACT

A method of steering a planning V-bottomed boat with double individually steerable outboard drive units with underwater housings (6), which extend down from the bottom (1) of the boat. When running at planning speed straight ahead, the underwater housings are set with "toe-in", i.e. inclined towards each other with opposite angles (alpha) of equal magnitude relative to the boat centre line (b). When turning, the inner drive unit is set with a greater steering angle than the outer drive unit.

17 Claims, 3 Drawing Sheets

Figure 1:
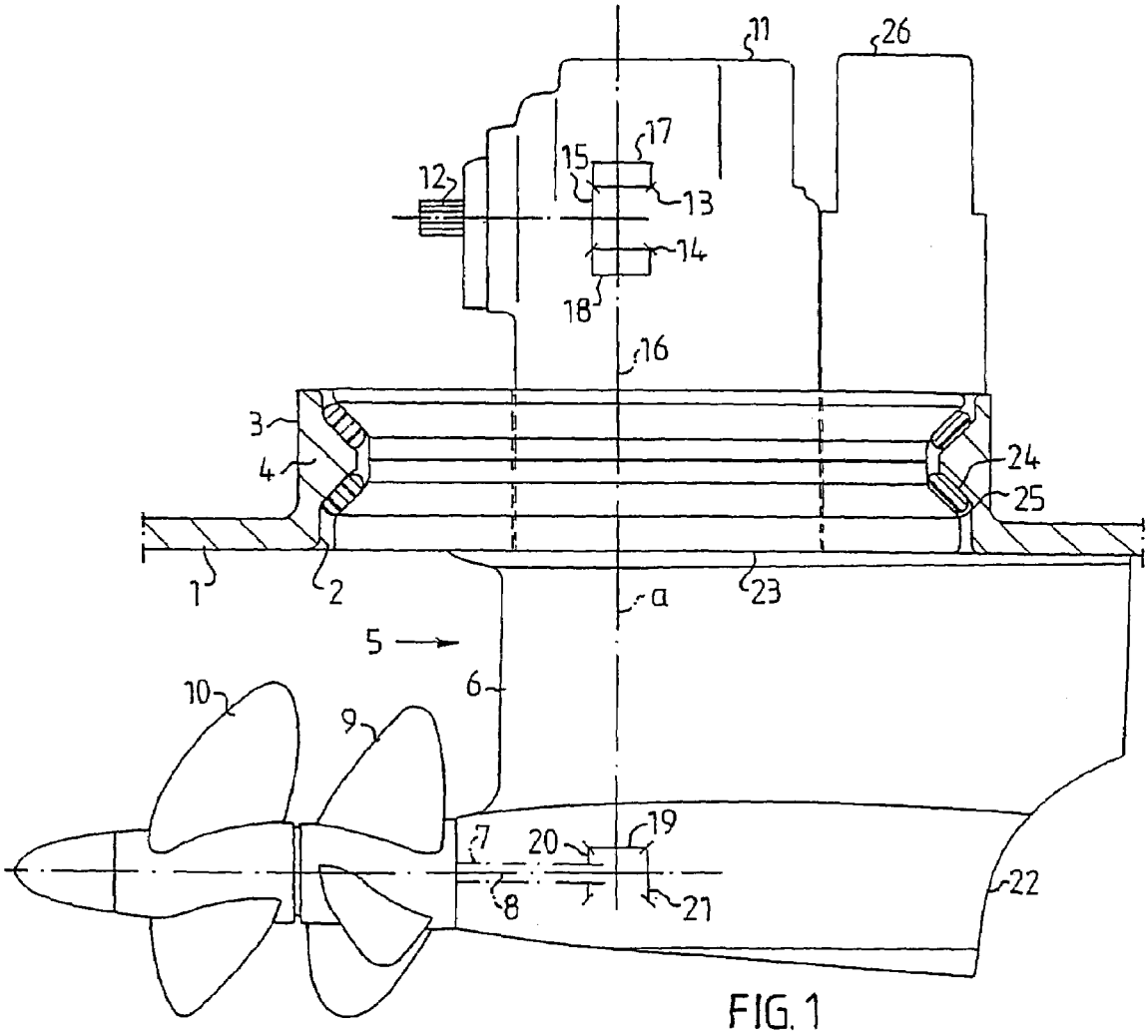

METHOD OF STEERING A BOAT WITH DOUBLE OUTBOARD DRIVES AND BOAT HAVING DOUBLE OUTBOARD DRIVES

The present invention relates to a method of steering a boat having a V-bottomed hull designed for planing, in which an outer drive unit with at least one propeller is mounted on each side of a longitudinal centre line of the hull bottom, each of said drive units comprising an underwater housing extending down from the outside of the hull bottom and being rotatably mounted relative to the hull, and an at least substantially vertical drive shaft being rotatably mounted in said underwater housing and driving, via a bevel gearing enclosed in the underwater housing, at least one substantially horizontal propeller shaft mounted in the underwater housing.

The invention also relates to a boat with outboard drive units, comprising a V-bottomed hole designed for planing, in which an outboard drive unit with at least one propeller is mounted on either side of a longitudinal centre plane of the hull, in which an outboard drive unit with at least one propeller is mounted on either side of a longitudinal centre line of the hull, each of said drive units comprising an underwater housing extending down from the outside of the hull bottom and rotatably mounted relative to the hull, an essentially vertical drive shaft being rotatably mounted in said underwater housing and driving, via bevel gearing, an at least substantially horizontal propeller shaft mounted in the underwater housing and coordinated force actuated means, by means of which the drive units are individually steerable as a function of the setting of the manually operated steering means.

A V-bottomed planing boat with two individually steerable outboard drive units with underwater housings, mounted so that they extend at a 90° angle from the bottom of the hull, are known by SE-A-9402272-0 for example. This publication describes a method of steering the drive units when driving straight ahead, so that one drive unit is set to turn the boat in one direction while the other drive unit is set to turn the boat in the opposite direction. The drive units are set in this case with "toe-out", i.e. the propeller axes converge aftwards. The purpose of this method of steering is, as with trim tabs, to achieve an upward force acting on the aft portion of the boat, helping the boat to get up on plane.

At speeds over the planing threshold, drive installations of the type described in V-bottomed boats are subjected to significant lateral forces from the water flowing by, not only when turning but also when driving straight ahead, where the drive mounting in the hull in particular is subjected to significant stresses, which must be taken into account in the dimensioning thereof. Studies have shown, somewhat surprisingly, that the waterflow along the bottom of the aft portion of a V-bottomed boat at planing speed is not entirely parallel to the hole bottom. The water flows instead from the centre portion of the hull bottom obliquely aft towards the side. Even if the angle is very small, only one or two degrees, the resulting lateral forces on the underwater housing and steering mechanism of the drive units are not negligible. When turning, the forces on the underwater housing of the drive unit are, of course, larger than when driving straight ahead, especially the forces on the underwater housing of the outer drive unit in relation to the centre of the turning curve. On the other hand, the total operating time, during which a boat turns, is relatively small in relation to the time when the boat is moving straight ahead.

A purpose of the present invention is to achieve a method of steering a boat with outboard drive units of the above-mentioned type, which makes it possible to reduce the forces on the drive units without negatively affecting performance and manoeuvrability.

This is achieved according to the invention by virtue of the fact that, at speeds above the planing threshold, when driving straight ahead, the underwater housings of the drive units are set with equal angles inclined towards each other, so that the propeller axes converge in the forward direction and that, when turning, the underwater housing of the drive unit closes to the centre of the turning curve is set at a greater steering angle in relation to said centre plane than the other drive unit.

By setting the underwater housings of the drive units inclined towards each other, so that the propeller axes are parallel to the waterflow when driving straight ahead, the lateral forces on the underwater housings are reduced to a minimum. Tests have shown that this can be achieved without using the total efficiency. When turning, the boat is in principle only steered by the inner drive unit, while the outer drive unit is set parallel to the waterflow across the outer half of the bottom. In practice, this means that if the underwater housing of the inner drive unit requires a steering angle of 25° to make the boat perform a desired turn, it will be sufficient to set the underwater housing of the outer drive unit at a steering angle of circa 10° relative to the fore and aft centreline in order for the propeller axis to be parallel to the waterflow. Tests have shown that steering in this manner has no negative effect on steerability, while lateral forces on the underwater propeller housing of the outer drive unit are appreciably reduced.

A boat with an outboard drive unit of the type described by way of introduction, which can be steered in this manner, is characterized according to the invention in that said steering means are coordinated with sensors disposed to provide signals dependent on the steering means deviation to an electronic steering unit, into which there are also fed signals from a tachometer and/or a knot meter indicating speed over or below the hull planing threshold, and in that the steering unit is disposed to provide signals to said actuators to set the steering angles of the underwater housings as a function of the signals fed in, so that, when there are signals indicating running straight ahead and speed above the planing threshold, the underwater housings will be set at angles of equal magnitude, inclined towards each other with the propeller axes converging forwards and so that, when there are signals indicating turning and speed above the planing threshold, the underwater housing closest to the centre of the turning curve will be set at a greater steering angle relative to said centre plane than the other underwater housing.

Figure 2:
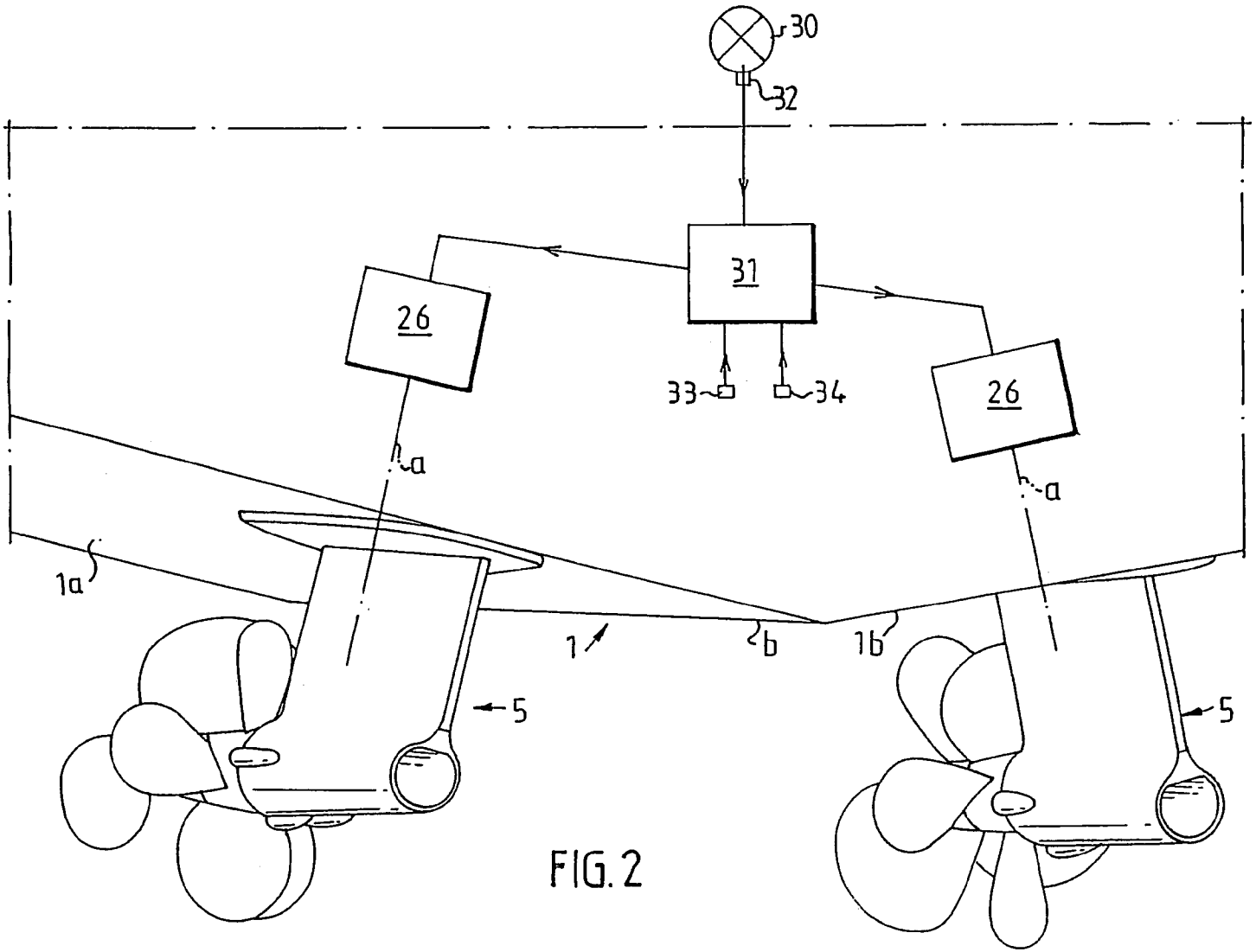
Figure 3B:
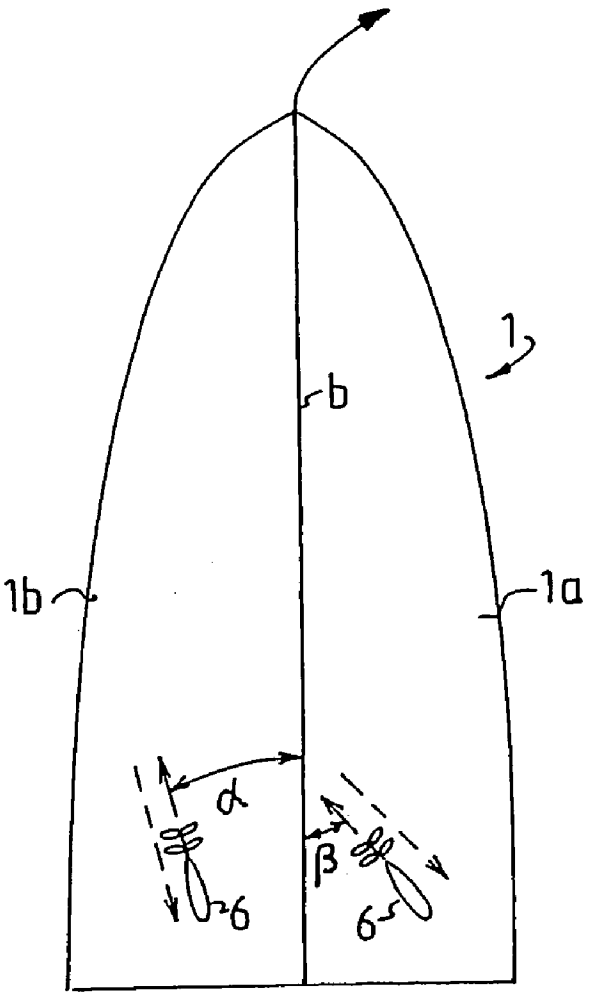
Figure 3A:
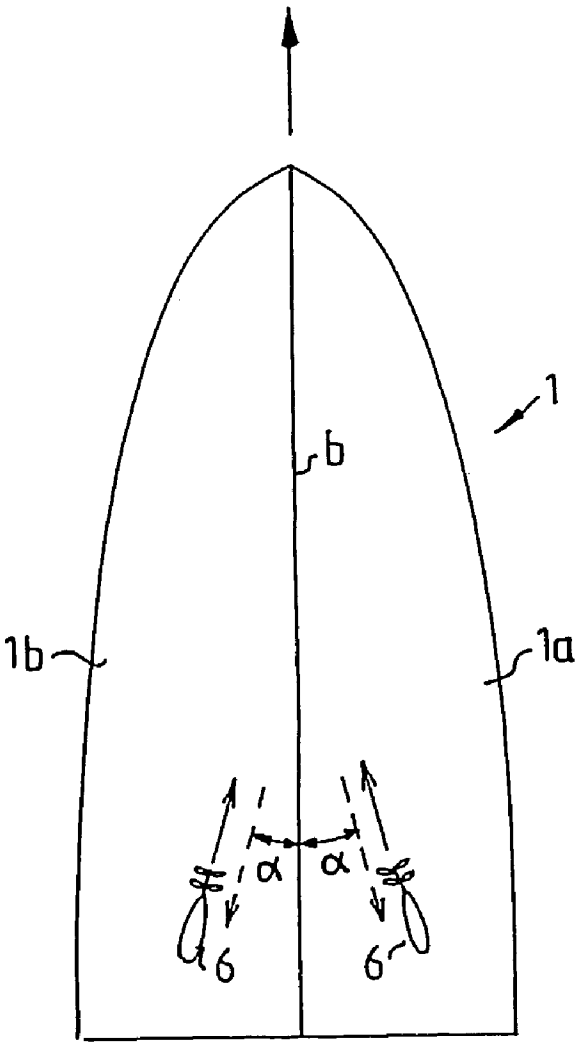

The invention will be described in more detail below with reference to examples shown in the accompanying drawings, where FIG. 1 shows a longitudinal section through a section of a boat bottom with a side view of a schematically represented steerable outboard drive unit, FIG. 2 is a schematic representation of the aft portion of a boat with two outboard drive units of the type shown in FIG. 1, and FIGS. 3*a* and 3*b* are plan views of a boat hull illustrating drive unit angle and waterflow during two different running situations. In FIG. 1, 1 designates the bottom of a boat hull, which can be of cast fibreglass reinforces polyester plastic. The bottom of the hull is made with an opening 2, which is surrounded by a vertical well 3, which extends into the interior of the hull. The well is preferably cast in one piece with the bottom 1 and is made with an inwardly directed peripheral flange 4 which, in the example shown, has an essentially triangular cross section.

The well 3 with the flange 4 forms a mounting arrangement for a propeller drive unit, generally designated 5, which, in the example shown, has an underwater housing 6, in which two concentric shafts 7 and 8, each having a propeller 9 and 10 respectively, are rotatably mounted. The underwater housing 6 is joined to a gear housing 11, in which a horizontal drive shaft 12 is rotatably mounted. The shaft 12 is designed to be coupled to an output shaft from a motor (not shown). The shaft 12 drives, via a bevel gearing enclosed in the gear housing 11 and comprising bevel gears 13, 14 and 15, a vertical shaft 16. The gears 13 and 14 are rotatably mounted on the shaft 16 and are alternately lockable to the shaft, each by means of an individual wet multi-disc clutch 17 or 18, respectively, for driving the shaft 16 in one or the other rotational direction. Via a bevel gearing enclosed in the underwater housing 6 and comprising gears 19, 20 and 21, the shaft 16 drives the propeller shafts 7 and 8 in opposite rotational directions. In the example shown, the propellers 9 and 10 are pulling propellers disposed in front of the underwater housing 6, which has at its rear end an exhaust port 22.

The drive unit 5 is mounted in the opening 2 with the aid of mounting elements, generally designated 23 and grips the flange 4 with spacer elements between them in the form of a pair of vibration-damping and sealing elastic rings 24 and 25. The underwater housing 6 is mounted in the mounting element 23 for rotation about a pivot and steering axis "a" coinciding with the drive shaft 16. The rotation of the underwater housing 6 is achieved with the aid of a servomotor 26, which can be an electric motor with a gear fixed on a shaft and engaging a toothed rim (not shown) joined to the underwater housing.

FIG. 2 shows the aft portion of a boat hull with a V-formed bottom 1. On each bottom portion 1*a* and 1*b*, respectively, and equidistant from the centre plane "b" of the bottom there is an outboard drive unit 5 of the type shown in FIG. 1. The drive units 5 can be mounted in the manner illustrated in FIG. 1. In FIG. 2, 30 designates a steering wheel at a helm position and 31 designates an electronic steering unit, which can comprise a computer. The steering unit 31 is electrically connected to the servomotors 26 to each drive unit 5. With the aid of the respective servomotors 26, the underwater housings 6 of the drive units can be turned independently of each other about their pivot axes "a" in response to signals from the steering unit 31 for steering the boat.

The steering wheel 30 is coupled to a sensor 32, which senses how far the steering wheel is turned from a starting position, i.e. the position for running straight ahead, and sends a steering wheel position signal to the steering unit 31. In the example shown, signals are also fed in from a tachometer 33 and a knot meter (speedometer) 34 to the steering unit 31 to provide information on whether the boat is running below or above its planing threshold. In principle, signals from either the tachometer 33 or the knot meter 34 are sufficient to compute the boat speed. In the steering unit 31 there are stored various values of drive unit steering angles as a function of how far the steering wheel 30 is turned.

When the sensor 32 indicates running straight ahead at the same time as the tachometer 33 and/or the knot meter 34 indicates speed above boat planing threshold, the steering unit 31 is programmed, in accordance with the invention, to set the underwater housings 6 of the drive units 5 at the same angle $\alpha$ relative to the centre line "b", i.e. a "toe-in" position, as shown in FIG. 3*a*, in which the solid arrows indicate the propeller axis, while the dashed arrows indicate the direction of the waterflow. As is shown in FIG. 3*a*, the underwater housings 6 are now set, so that the water flows parallel to the houses 6, which results in negligible lateral forces on the houses 6 when running straight ahead. In FIG. 3, the angles $\alpha$ of the underwater housings 6 relative to the centre line "b" are greatly exaggerated. In practice, the angles $\alpha$ are only one or two degrees.

When the sensor 32 indicates turning, e.g. a starboard turn as shown in FIG. 3*b*, at the same time as the tachometer 33 and/or the knot meter 34 indicate a speed above boat planing threshold, the steering unit 31 is programmed, in accordance with the invention, to set the underwater housing 6 of the inner drive unit 5 (that closest to the centre of the turning curve) to a larger angle $\beta$ relative to the centre plane "b" than the angle $\alpha$ of the underwater housing 6 of the outer drive unit, as is illustrated in FIG. 3*b*. Note that FIG. 3*b*, as well as FIG. 3*a*, is not drawn to scale. In a practical embodiment, the maximum steering angle of the underwater housing of the inner drive unit can only be circa 25°, and in that case the underwater housing of the outer drive unit would be set at an angle of circa 10°. A general rule for the drive unit type described is that the ratio between the outer and the inner drive steering angles should be circa 1:2.5 for the waterflow about the outer drive when turning to be parallel to or nearly parallel to the propeller axis of the drive unit. It has been shown that steering in this manner does not affect the turning capacity in comparison with parallel turning of the drive units. However, the lateral forces on the outer drive unit are reduced and thus the braking effect of the drive unit when turning.

Finally, the steering unit 31 is programmed to steer the drive units parallel when the tachometer 33 and/or the knot meter 34 indicate a speed below the planing threshold regardless of whether the steering wheel sensor 32 indicates running straight ahead or turning.

The invention claimed is:

1. Method of steering a boat having a V-bottomed hull designed for planing, in which an outer drive unit (5) with at least one propeller (9, 10) is mounted on each side of a longitudinal centre line (b) of the hull bottom (1), each of said drive units comprising an underwater housing (6) extending down from the out-side of the hull bottom and being rotatably mounted relative to the hull, and an at least substantially vertical drive shaft (16) being rotatably mounted in said underwater housing (6) and driving, via a bevel gearing (19, 20, 21) enclosed in the underwater housing, at least one substantially horizontal propeller shaft (7, 8) mounted in the underwater housing, characterized in that, at speed above the hull planing threshold, when running straight ahead, the underwater housings (6) of the drive units are set at angles ($\alpha$) of equal magnitude inclined towards each other, so that the rotational axes of the propellers (9, 10) converge in the forward direction, and that, when turning, the underwater housing (6) closest to the centre of the curve is set at a greater steering angle ($\beta$) relative to said centre plane (b) than the other drive unit.

2. Method of steering a boat according to claim 1, characterized in that the underwater housings (6) of the drive units, when driving straight ahead at speeds above the hull planing threshold, are set at an angle ($\alpha$) of circa 1.5° relative to said centre plane (b).

3. Method of steering a boat according to claim 1, characterized in that the underwater housings (6) of the drive units, when turning at speeds above hull planing threshold, are set at an angular ratio of circa 1:2.5 between the outer and inner housings (6).

4. Method of steering a boat according to claim 1, characterized in that the underwater housings (6) of the drive units, at speeds below the hull planing threshold, are steered at least substantially parallel both when running straight ahead and when turning.

5. Boat with outboard drive units, comprising a V-bottomed hull designed for planing, in which an outboard drive unit (5) with at least one propeller (9, 10) is mounted on each side of a longitudinal centre plane (b) of the hull bottom (1), said drives each comprising an underwater housing (6) extending down from the bottom (1) of the hull and being rotatable relative to the hull, and an at least substantially vertical drive shaft (16) being rotatably mounted in said underwater housing (6) and driving, via a bevel gearing (19, 20, 21) enclosed in the underwater housing, at least one, at least substantially horizontal propeller shaft (7, 8) mounted in the underwater housing, and actuators (26) cooperating with respective drive units, by means of which the underwater housings of the drive units are individually steerable as a function of the setting of manually operated steering means (30), characterized in that said steering means (30) are coordinated with sensors (32) disposed to provide signals dependent on the steering means deviation to an electronic steering unit (31), into which there are also fed signals from a tachometer (33) and/or a knot meter (34) indicating speed over or below the hull planing threshold, and in that the steering unit is disposed to provide signals to said actuators to set the steering angles ($\alpha$, $\beta$) of the underwater housings (6) as a function of the signals fed in, so that, when there are signals indicating running straight ahead and speed above the planing threshold, the underwater housings will be set at angles ($\alpha$) of equal magnitude, inclined towards each other with the rotational axes of said propellers (9, 10) converging forwards and so that, when there are signals indicating turning and speed above the planing threshold, the underwater housing closest to the centre of the turning curve will be set at a greater steering angle ($\beta$) relative to said centre plane (b) than the other underwater housing.

6. Boat with outboard drive units according to claim 5, characterized in that the steering unit (31) is disposed, when there are signals indicating running at speeds below the planing threshold, to provide signals to said actuators (26) to set the underwater housings (6) parallel both when there are steering signals indicating running straight ahead and when there are steering signals indicating turning.

7. Boat with outboard drive units according to claim 5, characterized in that the electronic steering unit (31) is a control computer, storing various values of underwater housings (6) steering angles ($\alpha$, $\beta$) as a function of various steering deviations of the steering means (30).

8. Boat with outboard drive units according to claim 5, characterized in that the underwater housings (6) of the drive units are mounted below the hull bottom (1), so that the associated axes (a) about which the underwater housings are pivotable, extend normal to the hull bottom.

9. Boat with outboard drive units according to claim 5, characterized in that said actuators (26) are electric servomotors.

10. Boat with outboard drive units according to claim 5, characterized in that two counter-rotating driven, concentric propeller shafts (7, 8) each having a pulling propeller (9, 10) fixed to a forwardly directed end, are mounted in the respective underwater housing (6).

11. Method of steering a boat according to claim 2, characterized in that the underwater housings (6) of the drive units, when turning at speeds above hull planing threshold, are set at an angular ratio of circa 1:2.5 between the outer and inner housings (6).

12. Boat with outboard drive units according to claim 6, characterized in that the electronic steering unit (31) is a control computer, storing various values of underwater housings (6) steering angles ($\alpha$, $\beta$) as a function of various steering deviations of the steering means (30).

13. Boat with outboard drive units according to claim 6, characterized in that the underwater housings (6) of the drive units are mounted below the hull bottom (1), so that the associated axes (a) about which the underwater housings are pivotable, extend normal to the hull bottom.

14. Boat with outboard drive units according to claim 7, characterized in that the underwater housings (6) of the drive units are mounted below the hull bottom (1), so that the associated axes (a) about which the underwater housings are pivotable, extend normal to the hull bottom.

15. Boat with outboard drive units according to claim 6, characterized in that said actuators (26) are electric servomotors.

16. Boat with outboard drive units according to claim 7, characterized in that said actuators (26) are electric servomotors.

17. Boat with outboard drive units according to claim 8, characterized in that said actuators (26) are electric servomotors.

* * * * *